United States Patent [19]

Bolza-Schunemann

[11] 4,289,494

[45] Sep. 15, 1981

[54] BRAKE FOR SHEET STACKS ON A FOLDING TABLE

[75] Inventor: Hans B. Bolza-Schunemann, Wurzburg, Fed. Rep. of Germany

[73] Assignee: Koenig & Bauer Aktiengesellschaft, Wurzburg, Fed. Rep. of Germany

[21] Appl. No.: 87,839

[22] Filed: Oct. 24, 1979

[30] Foreign Application Priority Data

Oct. 24, 1978 [DE] Fed. Rep. of Germany ..... 2846192

[51] Int. Cl.[3] ..... B65H 45/00

[52] U.S. Cl. ..... 493/405; 198/457; 198/633; 271/182

[58] Field of Search ..... 270/62, 67, 61 R, 80–85; 271/82, 182, 230, 245; 198/457, 633

[56] References Cited

U.S. PATENT DOCUMENTS 204,772 6/1878 Spalckhaver ..... 493/427

3,053,373 9/1962 Cross ..... 198/633

4,093,206 6/1978 Hartmann ..... 270/83

*Primary Examiner*—Edgar S. Burr

*Assistant Examiner*—A. Heinz

*Attorney, Agent, or Firm*—Jones, Tullar & Cooper

[57] ABSTRACT

A brake assembly for stopping moving sheet stacks on a folding table of a rotary printing press and a method of operating the brake assembly is disclosed. A rotatable drum carries a plurality of axially extending stop rods spaced about the periphery of the drum. Each of these stop rods is carried on bearing arms that are spring biased. Each moving sheet stack contacts a stop rod which absorbs the energy of the moving sheet stack and causes it to stop on the folding table. The drum rotates in an intermittent fashion to bring a different stop bar into engagement with each succeeding sheet stack. A gear drive assembly for the brake assembly is also disclosed.

10 Claims, 3 Drawing Figures

BRAKE FOR SHEET STACKS ON A FOLDING TABLE

CROSS REFERENCE TO RELATED APPLICATIONS

The present patent application is related to my U.S. patent application Ser. No. 087,847 entitled "Folder For A Web-Fed Rotary Printing Press", filed Oct. 24, 1979, assigned to the assignee of the present application, and corresponding to German application P28 46 191.8.

FIELD OF THE INVENTION

The present invention is directed to a method and to apparatus for executing this method to rapidly brake moving sheet stacks or the like as they are rhythmically fed, for example, on the folding table of a rotary printing press. The apparatus includes an intermittently rotatable drum which carries a plurality of spring biased brake or stop rods, each of these rods being contacted by a moving sheet stack to absorb the energy of the moving stack and to halt this motion prior to a folding operation or the like.

DESCRIPTION OF THE PRIOR ART

Particular problems exist in folders in rotary printing presses, when sheet stacks are braked on a folding table and are pushed into counter-rotating folding rollers by means of a folding blade. The sheet stacks are conveyed at a high speed against stops, from which they rebound in a straight or oblique direction, from which, particularly at higher speeds, intolerable folding inaccuracies may well result.

To overcome such deficiencies, braking mechanisms of different designs have been proposed. For example, for the longitudinal fold, or in so-called third folding mechanisms, the folding blade enters into the signature to be folded before the signature has reached the stops on the folding table to attain, in this way, a braking effect. Such a braking effect is, however, useful only within a limited range of speed. Alternatively, brushes or nipping devices which act on the sheet end have been used. All such known methods, however, have not proved satisfactory.

SUMMARY OF THE INVENTION

It is an object of the present invention to provide an improved procedure and a mechanism to brake sheet stacks which are moved on an area, before these sheet stacks are processed, for example, before these stacks are folded.

There is provided a method and apparatus to execute this method in accordance with the present invention to rapidly brake moving sheet stacks while they are rhythmically being fed to, for example, a folding device. The advantages which may be obtained in accordance with the present invention consist particularly in that sheet stacks moving on an area may effectively be braked even at high speeds before they are processed, for example, are folded, so that they come to rest with high precision at a prefixed point. Such abrupt braking does not damage the sheet stacks, nor are the signatures of sheets displaced with respect to each other.

The method of operation in accordance with the invention depends not on a braking effect produced on a sheet stack but on the exchange of pulses. Each moving sheet stack pushes against a movably suspended mass, and transfers its kinetic energy or its pulse to this movable mass, and then lies motionless and de-energized like a billiard ball which contacts another one with a centric push. The pulse is transferred onto the movable mass, the motion of which is subsequently braked. Therefore the method in accordance with the invention is not based on the object of braking a sheet stack, but on transferring the pulse of a moved sheet stack first of all onto another movable mass, and then on neutralizing the transferred kinetic energy within this second member.

As a further step of the method according to the present invention, the movable mass which takes the pulse, is immediately removed from the operating range of the pushing sheet stack, so that during de-energization and return of each movable mass to its original place, the position of the resting sheet stack is not altered.

In the embodiment of the present invention with respect to the high speeds used in rotary folders, a drum, which is intermittently moved by steps so that a plurality of movable masses in the form of stop rods, onto which the sheet stacks which are to be braked transfer their pulses, is provided for the technical execution of the method according to the invention. The drum is rotated to a new resting position after every push, and thus brings the next pulse-absorbing mass into its operating position. Simultaneously, the mass onto which a push was exercised, is immediately removed from the point of contact, so that each mass may swing out against stacks of springs or against shock absorbers or the like, and is subsequently capable of returning into a resting position relatively to the drum. Each pulse absorbing mass is thus no longer capable of contacting the sheet stack, nor of removing it, nor of retransferring any pulse to the sheet stack.

It is a further advantage of the present invention, that the pulse absorber operates at any speed in such a manner that the sheet stacks stay always lying on the same place, while the movable masses are pushed more or less violently. A folding blade entering into the sheet stack thus contacts every sheet stack at the same point, so that, within the whole speed range and thus also at the highest speeds, a very exact fold is guaranteed. There is no problem in braking even very heavy sheet stacks. Expediently, the pulse absorbing mass approximately corresponds to the mass or to the weight of the sheet stack.

BRIEF DESCRIPTION OF THE DRAWINGS

While the novel features of the braking method and the braking apparatus in accordance with the present invention are set forth with particularity in the appended claims, a full and complete understanding of the invention may be had by referring to the detailed description of preferred embodiments as set forth hereinafter and as shown in the accompanying drawings in which:

DESCRIPTION OF THE PREFERRED EMBODIMENTS

Figure 1:
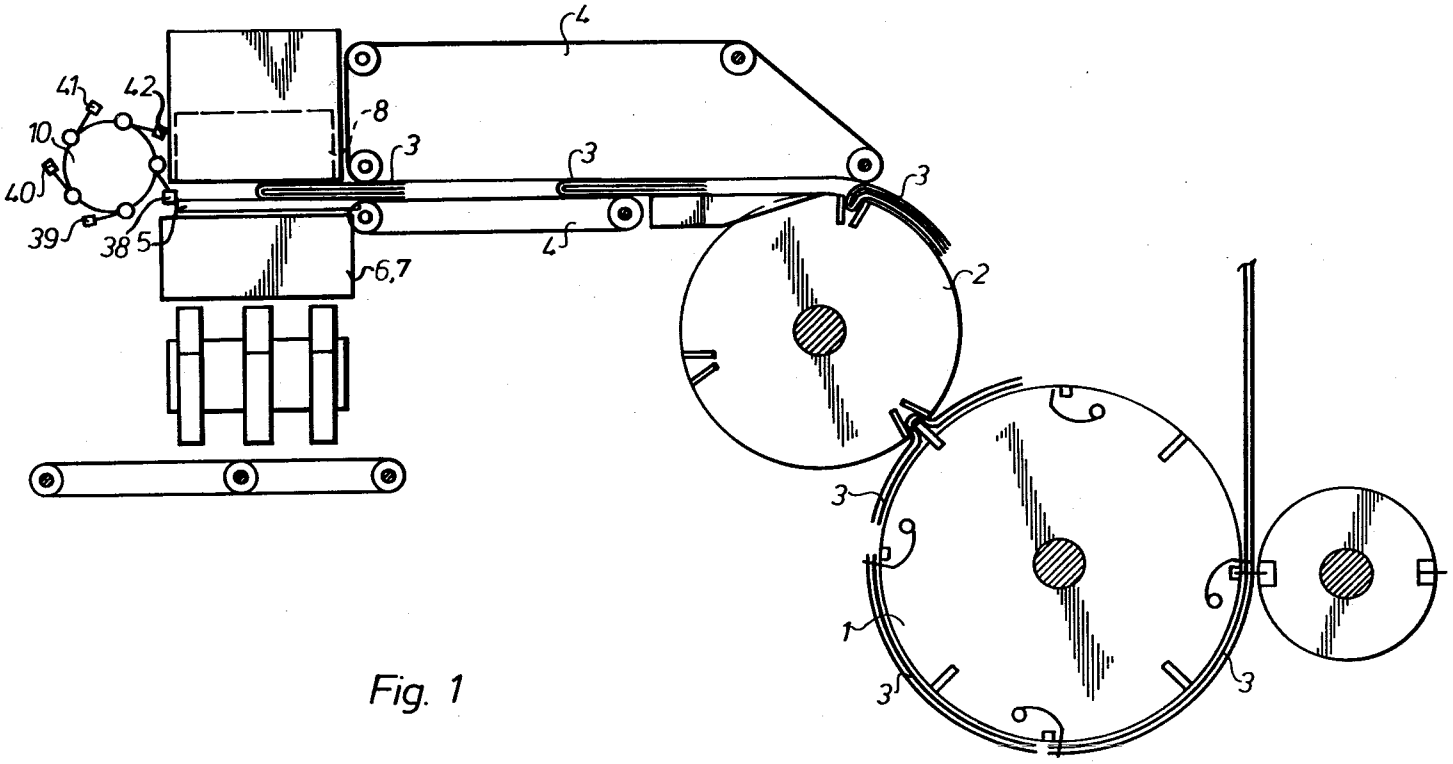
FIG. 1 is a schematic side view, partly in cross section, of a folder assembly comprising a longitudinal folding device and a sheet stack brake drum in accordance with the present invention.
Figure 2:
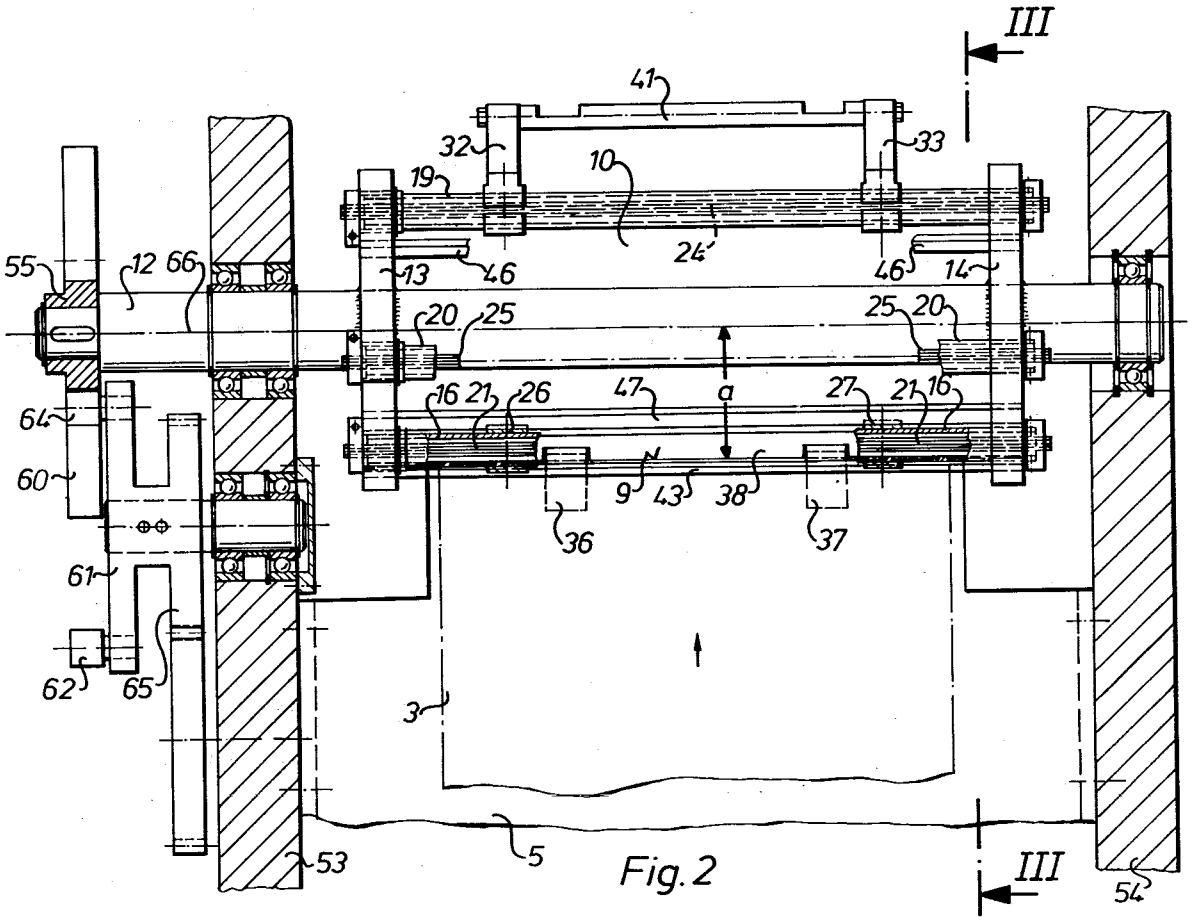
FIG. 2 is a schematic plan view, partly in cross section, of a sheet stack brake drum in accordance with the present invention with turned-out stop rod and drive for the sheet stack brake drum.
Figure 3:
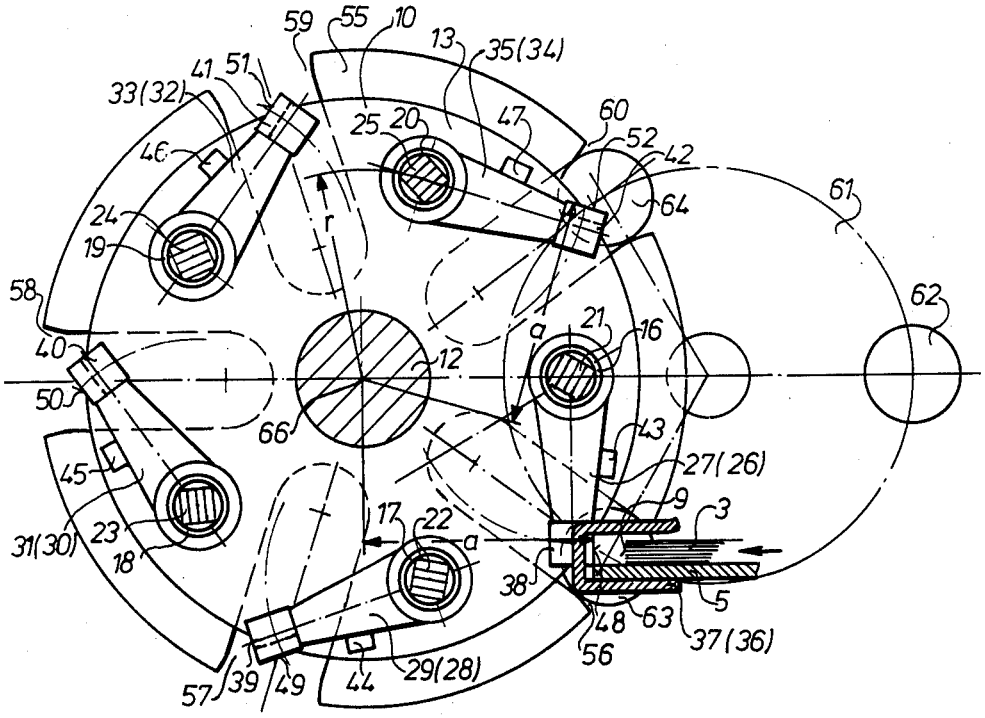
FIG. 3 is a schematic view, partly in cross section, and taken along the line III—III in FIG. 2 with the side frames removed for clarity.

Turning now to FIGS. 1-3, there may be seen a preferred embodiment of a brake assembly in accordance with the present invention.

FIGS. 1 to 3 show a preferred embodiment of the present invention being used in cooperation with a known second longitudinal fold producing means in a web-fed rotary printing press. Cut sheet stacks 3 composed of individual sheets, which were cross-folded by means of a folding blade cylinder 1 and a folding jaw cylinder 2, are conveyed by driven tape guides 4 onto a folding table 5 equipped with folding rollers 6, 7 provided below the folding table 5 and with a rotary folding blade 8. Every sheet stack 3 pushes at one of five brake or stop rods 38–42 which are movably supported in a brake drum 10, and are pressed by means of springs, or torsion bars, 21–25 into a resting position on the periphery of the brake drum 10, as seen in FIG. 3. The stop rods 38–42 are disposed at right angles to the direction of motion of the sheet stacks 3, and in such a manner that the sheet stacks 3 push with their faces 9 at the stop bars 38–42 and are thus capable of moving these stop rods 38–42 out of their resting position. In order to prevent the sheet stacks 3 from being moved beyond the folding table 5 or moving upwards, U-shaped stops 36, 37 are secured to the end of the folding table 5, as may also be seen in FIG. 3.

The brake drum 10 is moved by means of an intermittent drive gear, for example by a Maltese cross gear, in such a manner that the brake drum 10 instantaneously stops at the moment when a sheet stack 3 pushes against a movable stop rod 38–42. After the push, the stop rod 38–42 moves against increasing spring pressure toward the center of the brake drum 10, while the brake drum 10 is simultaneously rotated to its next rest position. Thus, a pushed mass, for example in the form of one of the stop rods 38–42, is immediately removed from the range of the sheet stack 3, and is no longer capable of touching and displacing the sheet stack 3 when it swings back. Furthermore, each such pushed mass 38–42 has sufficient time to return to a rest with respect to the stop drum 10, since four other sheet stacks 3 are seized before stop rod 38–42 again takes action. This is an advantage of the embodiment in accordance with the present invention, and this feature allows for very high operating speeds of the whole system.

An appropriate cage-shaped design of the brake drum 10 is shown in FIGS. 2 and 3. A shaft 12 is moved in steps of one fifth rotation each and carries brake drum 10. Two side flanges 13, 14, each with five borings provided on a circle having a radius "r", are fixed on the shaft 12. Hollow shafts 16, 17, 18, 19, 20 with torsion bars, or springs, 21, 22, 23, 24, 25 situated within hollow shafts 16–20 are supported in these borings capable of rotating. The hollow shafts 16–20 carry light-weight bearing arms 26–35, which support the actual stop rods 38–42. Stops 43–47, provided on the side flanges 13, 14, limit the oscillatory stroke of the stop rods 38–42. Each arriving sheet stack 3 pushes more or less violently, according to its energy of motion against one of the stop rods 38–42 (mass) and comes to rest, free from energy, on folding table 5.

The FIGS. 2 and 3 furthermore show a driving system for the brake drum 10, which is very simple in spite of being capable of high efficiency, for example, of 45,000 stoppages per hour. A Maltese cross gear 55 having five slots 56–60, is secured upon the shaft 12. A driving plate 61 supported in side frame 53 carries three driving rollers 62, 63, 64, each staggered at 120°. These driving rollers 62, 63, 64 enter into the slots 56–60 of the Maltese cross gear 55. The residual angle of rotation of ±6° remaining between the slots 56–60 is covered by circular arc shaped prolongations of the slots 56–60, so that the driving rollers 63–64 also serve as reciprocal stop rollers for the short resting time of the Maltese cross gear 55. (A detailed description of such a driving system is set forth in German Pat. No. 17 61 074, in which patent, however, the driving system serves a different purpose.) The power input to the Maltese cross gear 55, 61 is effected by means of a gear 65, which is in functional conjunction with the drive of the folder. It is possible to structure flange 13 14 as a Maltese cross gear to cooperate with a driving plate 61 in the embodiment in accordance with the invention.

The present invention is not to be limited to the preferred embodiment described above. More or less than five movable masses 38–42 may be fixed in the brake drum 10. Such movable masses 38–42 may have a rectilinear movement instead of being capable of moving like a pendulum around a synchronizing center of rotation. Instead of the torsion bars 21–25, other arresting means could be provided as well as additional shock absorbers. The center of rotation of the pulse absorbing drum 10 could be disposed above or below the folding table 5. The utilization of the drum-like pulse absorber 10 is not limited to the second longitudinal fold in a rotary folder, since this drum-like absorber could generally be utilized where rhythmically fed sheet stacks, or books, or the like are to be braked rapidly. Accordingly, the present invention is to be limited only by the following claims.

I claim:

1. A brake apparatus to slow-down and stop moving sheet stacks on a folding table of a web-fed rotary printing machine, said brake apparatus comprising:

a plurality of resiliently supported stop rods, each of said stop rods being disposed horizontally and generally perpendicular to the direction of movement of said sheet stacks, a leading edge portion of each of said sheet stacks contacting one of said stop rods to move said rod from a rest position;

a rotatable brake drum, means mounting each said rod on said brake drum for rotation therewith to slow-down and stop the forward movement of the sheet stacks on said folding table; means for resiliently biasing each said rod to allow it to move a distance with a stack of sheets wherein Kinetic energy is transferred from the braked stack of sheets to the rod and biasing means and means for intermittently rotating said brake drum to position succeeding stop rods for contact by said leading edge of succeeding sheet stacks whereby each said sheet stack is braked by engagement with one of said resilient stop rods.

2. The brake apparatus of claim 1 wherein said brake drum includes a rotatable shaft having spaced side flanges secured to said shaft.

3. The brake apparatus of claim 2 wherein said stop rods are secured between bearing arms which are rotatably carried by said side flanges.

4. The brake apparatus of claim 3 wherein said bearing arms are secured to hollow shafts which are rotatably carried in borings in said side flanges.

5. The brake apparatus of claim 4 wherein torsion bars are carried within said hollow shafts to resiliently support said stop rods.

6. The brake apparatus of claim 4 wherein springs are carried within said hollow shafts to resiliently support said stop rods.

7. The brake apparatus of claim 2 wherein said side flanges have guiding slots, said stop rods being supported for movement within said guiding slots.

8. The brake apparatus of claim 2 wherein one of said side flanges is a Maltese cross gear provided with slots, with each of said slots having a circle shaped extension, said Maltese cross gear cooperating with a driving plate equipped with three driving and blocking rollers staggered at 120°, said driving plate making one third of a rotation with respect to each of said sheet stacks.

9. The brake apparatus of claim 1 wherein said means for intermittently rotating said brake drum includes Maltese cross gear.

10. The brake apparatus of claim 9 or 8 wherein said Maltese cross gear consists of five parts.

* * * * *